US008602496B2

(12) United States Patent
Lu

(10) Patent No.: US 8,602,496 B2
(45) Date of Patent: Dec. 10, 2013

(54) CHAIR WITH BACK-AND-FORTH MOVING BACKREST

(75) Inventor: Shunjie Lu, Dongguan (CN)

(73) Assignee: Shunjie Lu, Dongguan (CN)

( * ) Notice: Subject to any disclaimer, the term of this patent is extended or adjusted under 35 U.S.C. 154(b) by 416 days.

(21) Appl. No.: 12/983,495

(22) Filed: Jan. 3, 2011

(65) Prior Publication Data

US 2011/0233983 A1 Sep. 29, 2011

(30) Foreign Application Priority Data

Mar. 27, 2010 (CN) ..... 2010 1 0138032

(51) Int. Cl.
*A47C 1/024* (2006.01)

(52) U.S. Cl.
USPC ..... 297/354.11; 297/285

(58) Field of Classification Search
USPC ..... 297/354.11, 291, 285
See application file for complete search history.

(56) References Cited

U.S. PATENT DOCUMENTS 3,910,632 A * 10/1975 Marechal ..... 297/232
4,709,963 A * 12/1987 Uecker et al. ..... 297/300.5
6,464,297 B2 * 10/2002 Garrido et al. ..... 297/354.13
6,820,928 B1 * 11/2004 Ransom ..... 297/29
7,104,607 B2 * 9/2006 Yasuda et al. ..... 297/354.1
7,347,496 B1 * 3/2008 Wang ..... 297/383
7,422,287 B2 * 9/2008 Heidmann et al. ..... 297/354.1
7,475,943 B1 * 1/2009 Huang ..... 297/284.4
2002/0180250 A1 * 12/2002 Kinoshita et al. ..... 297/354.11
2006/0202536 A1 * 9/2006 Luchetti et al. ..... 297/354.11
2008/0030059 A1 * 2/2008 Deimen et al. ..... 297/354.11
2010/0148556 A1 * 6/2010 Chou ..... 297/354.11

* cited by examiner

*Primary Examiner* — David Dunn
*Assistant Examiner* — Timothy J Brindley
(74) *Attorney, Agent, or Firm* — Westman, Champlin & Koehler, P.A.

(57) ABSTRACT

A chair with a back-and-forth moving backrest comprises a seat and a backrest, the lower end of the backrest is separated from the seat; both sides of the lower end of the backrest are respectively connected with both sides of the back end of the seat by a rotating mechanism; the lower end of the rotating mechanism can be rotatably regulated relatively to the seat; the upper end of the rotating mechanism can be rotatably regulated relatively to the backrest; during the rotating regulation of the rotating mechanism, the backrest only moves back and forth relatively to the seat without changing the vertical state of the backrest.

13 Claims, 15 Drawing Sheets

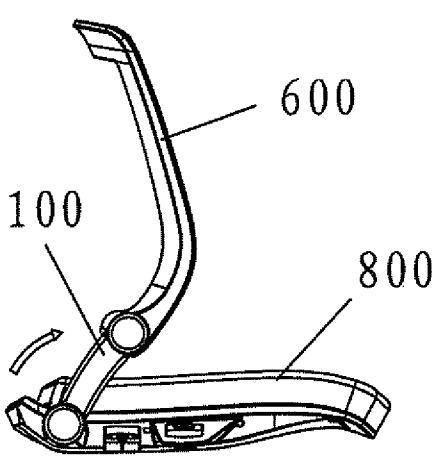
Fig. 1-3
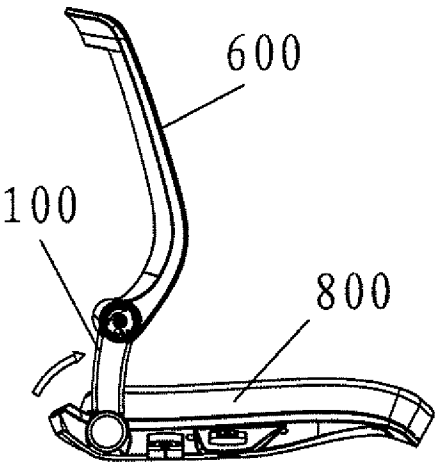
Fig. 1-2
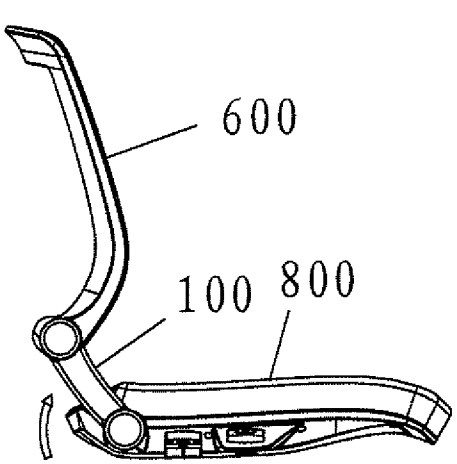
Fig. 1-1
Fig. 1

C - C

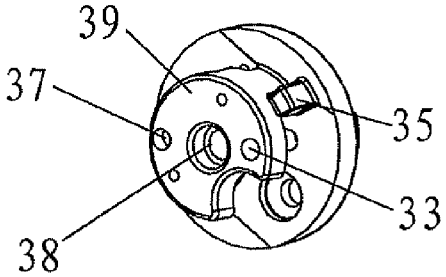
Fig. 9-1
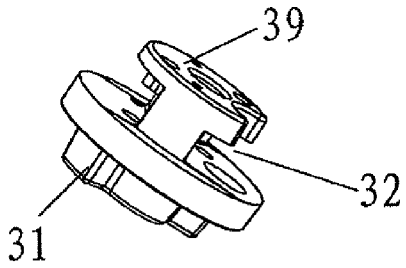
Fig. 9-2
Fig. 9
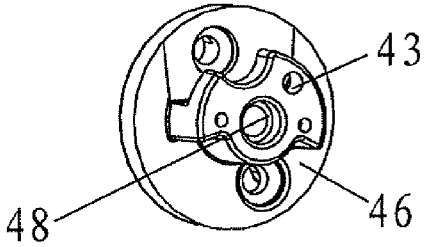
Fig. 10-1
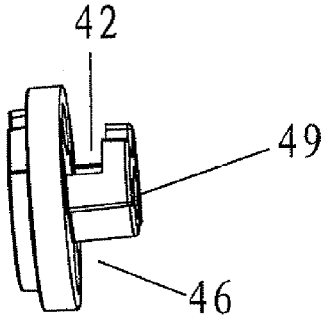
Fig. 10-2
Fig. 10
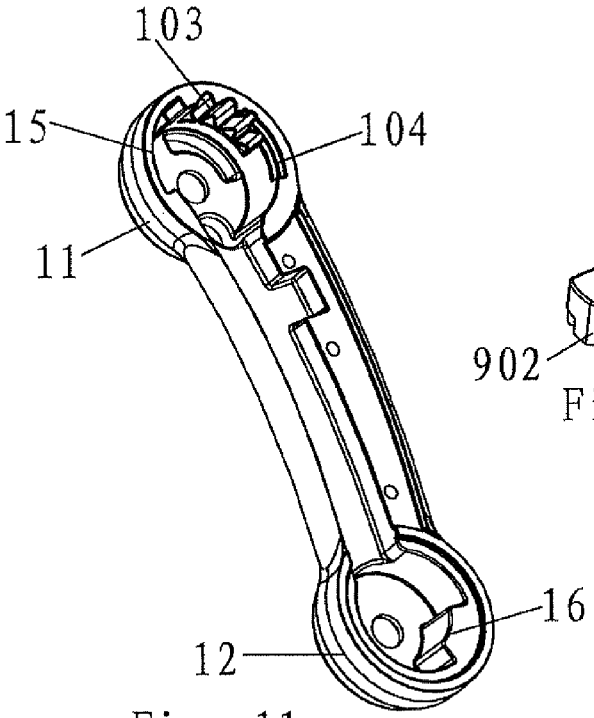
Fig. 11
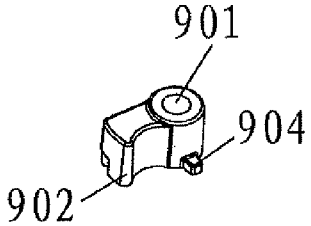
Fig. 12-1
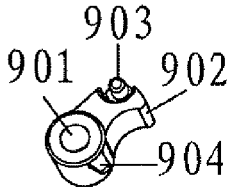
Fig. 12-2
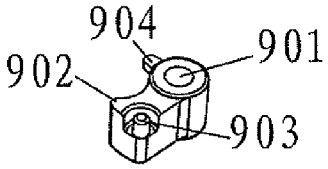
FIg. 12-3
Fig. 12

CHAIR WITH BACK-AND-FORTH MOVING BACKREST

The present application claims priority of Chinese patent application Serial No 0.201010138032.X, filed Mar. 27, 2010, the content of which is hereby incorporated by reference in its entirety.

FIELD OF THE INVENTION

The invention relates to a chair, in particular a chair with a back-and-forth moving backrest.

BACKGROUND OF THE INVENTION

With the progress of society and the improvement of living standards, people put forward more and higher requests for working and living environments and articles. Take chairs for example, office chairs or other chairs in diversified designs increasingly appear to meet people's different needs, such as a lifting regulation chair, a chair with a regulatable waist cushion, a chair with a regulatable headrest, a chair with a backrest in regulatable inclination and elevation, etc. However, for all kinds of chairs in the prior art, a backrest is directly connected or integrated with a seat or is connected with the seat by a support rod, and thus, for such chairs, even if the backrest can be regulated relatively to the seat, the backrest is regulated for angle change relatively to the seat, so as to be suitable for people to sit up and lean back. As yet, a chair with a backrest which can move back and forth relatively to a seat has not appeared.

SUMMARY

The invention aims at avoiding the deficiencies of the prior art, and thus, the invention discloses a chair with a back-and-forth moving backrest. A user can regulate the backrest of the chair to move back and forth as required so that the back of the user always rests against the backrest to obtain favorable comfortableness.

The invention can solve the technical problems by the following technical scheme:

A chair with a back-and-forth moving backrest is designed and made. The chair with a back-and-forth moving backrest comprises a seat and a backrest, wherein, the lower end of the backrest is separated from the seat; both sides of the lower end of the backrest are respectively connected with both sides of the back end of the seat by a rotating mechanism; the lower end of the rotating mechanism can be rotatably regulated relatively to the seat; the upper end of the rotating mechanism can be rotatably regulated relatively to the backrest; during the rotating regulation of the rotating mechanism, the backrest only moves back and forth relatively to the seat without changing the vertical state of the backrest.

As the specific further improvement of the invention, the rotating mechanism comprises a first rotating rod, a second rotating rod, a first rotating joint and a second rotating joint, wherein, the first rotating rod is hollow and is generally in a dumbbell shape, the upper end and the lower end are big and are in a cylinder shape, and the middle segment is small and is in a bar shape; both ends of the second rotating rod are respectively provided with a circular hole; the first rotating joint is generally in a circular cylinder shape, the middle segment is big, and the inner segment and the outer segment are small; the first rotating joint and a first mounting seat at the side of the lower end of the backrest are connected and fixed, and the inner end of the first rotating joint is inserted into the first mounting seat; the second rotating joint is generally in a circular cylinder shape, the middle segment is big, and the inner segment and the outer segment are small; the second rotating joint and a second mounting seat at the side of the back end of the seat are connected and fixed by screws, and the inner end of the second rotating joint is inserted into the second mounting seat; the inner part of the first rotating joint is provided with a first groove radially and is provided with a first shaft hole axially; the upper end of the second rotating rod is positioned in the first groove and is inserted into the first shaft hole and the circular hole in the upper end of the second rotating rod by a first shaft rod so as to realize the rotatable connection of the second rotating rod and the first rotating joint; the inner part of the second rotating joint is provided with a second groove radially and is provided with a second shaft hole axially; the lower end of the second rotating rod is positioned in the second groove and is inserted into the second shaft hole and the circular hole in the lower end of the second rotating rod by a second shaft rod so as to realize the rotatable connection of the second rotating rod and the second rotating joint; the upper end of the first rotating rod is sheathed with the outer end of the first rotating joint, and the lower end of the first rotating rod is sheathed with the outer end of the second rotating joint; the upper end of the first rotating rod is provided with a first center circular hole, and the lower end of the first rotating rod is provided with a second center circular hole; the upper part of the first rotating joint is provided with a first center hole, and the upper part of the second rotating joint is provided with a second center hole; the rotating mechanism comprises a first screw rod and a second screw rod, only the final segment of each of the two screw rods is provided with external threads, and the residual rod segments are polished rod segments; the first screw rod is screwed in a threaded hole arranged in the first mounting seat after the first screw rod passes through the first center circular hole and the first center hole in turn, and the second screw rod is screwed in a threaded hole arranged in the second mounting seat after the second screw rod passes through the second center circular hole and the second center hole in turn, so as to ensure that the upper end of the first rotating rod can rotate relatively to the first screw rod, and the lower end of the first rotating rod can rotate relatively to the second screw rod; the connecting line of the first center hole and the first shaft hole is in parallel with the connecting line of the second center hole and the second shaft hole, and the connecting line of the first center hole and the second center hole is in parallel with the connecting line of the first shaft hole and the second shaft hole.

A first sleeve is arranged between the first screw rod and the first center circular hole, and a second sleeve is arranged between the second screw rod and the second center circular hole; the end of the first sleeve and the end of the second sleeve are both provided with sawteeth, and the sawteeth are respectively inserted into the first center hole and second center hole; after the first sleeve and the second sleeve are arranged, the upper end of the first rotating rod can rotate relatively to the first sleeve, and the lower end of the first rotating rod can rotate relatively to the second sleeve.

A first spring is also arranged between the first rotating rod and the second rotating rod.

A spacing lug extrudes outwards from the arc wall of the outer end of the first rotating joint, and an arc-shaped groove matched with the spacing lug is arranged on the inner wall of the upper end of the first rotating rod.

The inner wall of the lower end of the first rotating rod is provided with an arc-shaped boss, and an arc-shaped space matched with the arc-shaped boss is left on the outer end of the second rotating joint.

In the invention, the rotating mechanism can also carry out multi-shift regulating control so that the backrest has several shifts relatively to the back-and-forth moving direction of the seat to be suitable for different needs of people of different types of figures, and the detailed design includes the following two modes (of course, other modes can also be used to realize the multi-shift regulating control of the rotating mechanism, and in the invention, the modes are not listed entirely): the rotating mechanism comprises a spacing regulating member which comprises a spacing regulating buckle, a mounting rotation shaft and a pressure spring, wherein, one end of the mounting rotation shaft can be rotatably mounted in a mounting hole arranged in the first rotating joint, the other end of the mounting rotation shaft is inserted into a circular hole in one end of the spacing regulating buckle, the other end of the spacing regulating buckle is provided with an arc-shaped lug boss, a wave groove matched with the lug boss is arranged on the inner wall of the upper end of the first rotating rod, one end of the pressure spring is connected with one end of the spacing regulating buckle with the arc-shaped lug boss, the other end of the pressure spring is connected with the first rotating joint by a fixed shaft, the mounting end of the spacing regulating buckle is provided with a small lug, an arc-shaped groove in which the small lug can move is arranged on the inner wall of the upper end of the first rotating rod, the end of the arc-shaped groove is the origin of the wave groove, and most of the spacing regulating member is positioned in the cavity of the first rotating joint; the rotating mechanism comprises a spacing regulating member which comprises an arc-shaped locking plate, a second spring and a regulating switch, wherein, the inner end of the arc-shaped locking plate passes through the first mounting seat, then, extends into the lower end of the backrest, and can move in the lower end of the backrest, the second spring supports the inner end of the arc-shaped locking plate, the outer end of the arc-shaped locking plate is provided with at least one locking tooth, an arc-shaped strip hole through which the arc-shaped locking plate passes is arranged in the first rotating joint, wave teeth matched with the locking tooth are arranged on the inner wall of the upper end of the first rotating rod, and the regulating switch comprises a button and a regulating rod which form an intersection angle mutually, wherein, the regulating rod can be rotatably mounted in the lower end of the backrest by a pin, and the end of the regulating rod is connected with the inner end of the arc-shaped locking plate by a reinforced core.

In the two design modes, three locking teeth are ideally designed and are evenly distributed.

The first rotating joint is removably connected with the first mounting seat by a third screw rod, and the upper end of the first rotating rod is provided with a through hole through which the third screw rod passes; the inner end of the first rotating joint is designed into a bowknot shape, and the inner part of the first mounting seat is designed to be matched with the inner end of the first rotating joint.

A rotating mechanism for a chair is designed and made, The rotating mechanism is connected between the side of the lower end of the backrest of the chair and the side of the back end of the seat, the lower end of the rotating mechanism can be rotatably regulated relatively to the seat, and the upper end of the rotating mechanism can be rotatably regulated relatively to the backrest; during the rotating regulation of the rotating mechanism, the backrest only moves back and forth relatively to the seat without changing the vertical state of the backrest.

Compared with the prior art, the chair with a back-and-forth moving backrest has the technical effects: a user can regulate the backrest of the chair to move back and forth so that the back of the user always rests against the backrest to obtain favorable comfortableness, and the chair with a back-and-forth moving backrest can be suitable for users of different types of figures; a spacing regulating member is arranged to enable the backrest to realize multi-shift back-and-forth movement so as to adapt to the needs of users' different sitting postures; the first rotating joint is removably connected with the first mounting seat by the third screw rod, and thus, if the third screw rod is not mounted, the backrest can be folded to close up to the seat, so that the chair with a back-and-forth moving backrest is convenient to transport.

BRIEF DESCRIPTION OF THE DRAWINGS

FIG. 1 is the schematic diagram of a chair with a back-and-forth moving backrest of the invention, comprising FIG. 1-1 to FIG. 1-3, showing the process that the backrest moves back and forth relatively to the seat;

FIG. 9 is the schematic diagram of the three-dimensional structure of the first rotating joint of Embodiment 1 of the chair with a back-and-forth moving backrest, comprising two three-dimensional figures in different directions, FIG. 9-1 and FIG. 9-2;

FIG. 10 is the schematic diagram of the three-dimensional structure of the second rotating joint of Embodiment 1 of the chair with a back-and-forth moving backrest, comprising two three-dimensional figures in different directions, FIG. 10-1 and FIG. 10-2;

FIG. 11 is the schematic diagram of the three-dimensional structure of the first rotating rod of Embodiment 1 of the chair with a back-and-forth moving backrest;

FIG. 12 is the schematic diagram of the three-dimensional structure of the spacing regulating buckle of Embodiment 1 of the chair with a back-and-forth moving backrest, comprising three three-dimensional figures in different directions, FIG. 12-1 to FIG. 12-3;

DETAILED DESCRIPTION OF THE VARIOUS EMBODIMENTS

Figure 2:
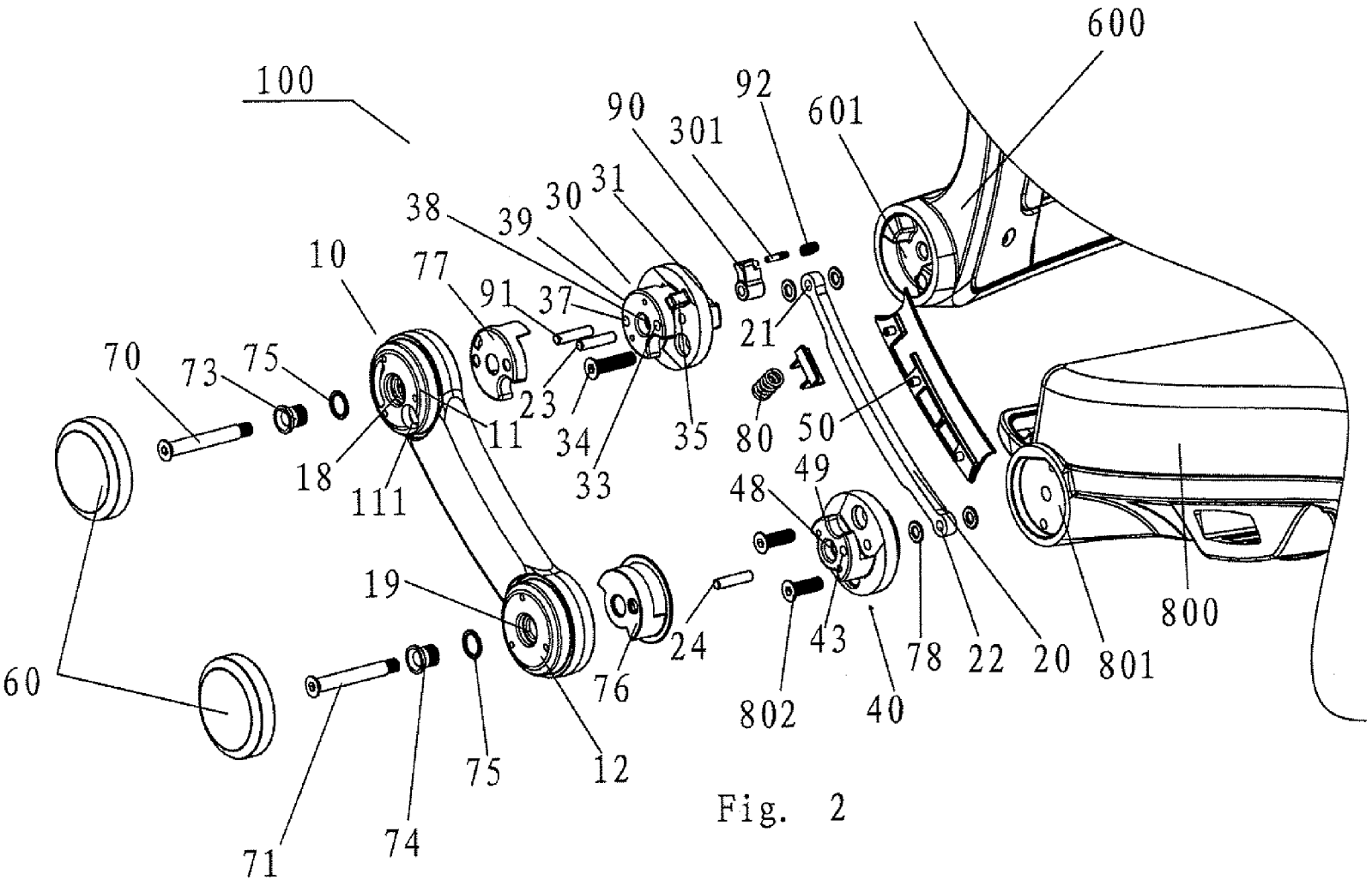
FIG. 2 is the schematic diagram of the three-dimensional disassembly of Embodiment 1 of the chair with a back-and-forth moving backrest.

The invention will further be described in details in accordance with the optimized embodiments shown in the figures.

A chair with a back-and-forth moving backrest, as shown in FIG. 1, comprises a seat 800 and a backrest 600, wherein, the lower end of the backrest 600 is separated from the seat 800; both sides of the lower end of the backrest 600 are respectively connected with both sides of the back end of the seat 800 by a rotating mechanism 100 (or 200); the lower end of the rotating mechanism 100 (or 200) can be rotatably regulated relatively to the seat 800; the upper end of the rotating mechanism 100 (or 200) can be rotatably regulated relatively to the backrest 600; during the rotating regulation of the rotating mechanism 100 (or 200), the backrest 600 only moves back and forth relatively to the seat 800 without changing the vertical state of the backrest 600.

Embodiment 1

In Embodiment 1 of the chair with a back-and-forth moving backrest of the invention, as shown in FIG. 2 to FIG. 7, the rotating mechanism connected between the seat 800 and the backrest 600 comprises a first rotating rod 10, a second rotating rod 20, a first rotating joint 30, a second rotating joint 40, an outer cap 50 and a circular end cap 60 covering the upper end 11 and the lower end 12 of the first rotating rod 10, wherein, the first rotating rod 10 is hollow and is generally in a dumbbell shape, the upper end 11 and the lower end 12 are big and are in a cylinder shape, and the middle segment is small and is in a bar shape (see FIG. 11); both ends of the second rotating rod 20 are respectively provided with a circular hole 21 and 22; the first rotating joint 30 is generally in a circular cylinder shape, the middle segment is big, and the inner segment and the outer segment are small (see FIG. 9); the first rotating joint 30 and a first mounting seat 601 at the side of the lower end of the backrest 600 are connected and fixed, and the inner end 31 of the first rotating joint 30 is inserted into the first mounting seat 601; the second rotating joint 40 is generally in a circular cylinder shape, the middle segment is big, and the inner segment and the outer segment are small (see FIG. 10); the second rotating joint 40 and a second mounting seat 801 at the side of the back end of the seat 800 are connected and fixed by screws 802, and the inner end of the second rotating joint 40 is inserted into the second mounting seat 801; the inner part of the first rotating joint 30 is provided with a first groove 32 radially and is provided with a first shaft hole 33 axially; the upper end of the second rotating rod 20 is positioned in the first groove 32 and is inserted into the first shaft hole 33 and the circular hole 21 in the upper end of the second rotating rod 20 by a first shaft rod 23 so as to realize the rotatable connection of the second rotating rod 20 and the first rotating joint 10; the inner part of the second rotating joint 40 is provided with a second groove 42 radially and is provided with a second shaft hole 43 axially; the lower end of the second rotating rod 20 is positioned in the second groove 42 and is inserted into the second shaft hole 43 and the circular hole 22 in the lower end of the second rotating rod 20 by a second shaft rod 24 so as to realize the rotatable connection of the second rotating rod 20 and the second rotating joint 40; the upper end 11 of the first rotating rod 10 is sheathed with the outer end 39 of the first rotating joint 30, and the lower end 12 of the first rotating rod 10 is sheathed with the outer end 49 of the second rotating joint 40; the upper end of the first rotating rod 10 is provided with a first center circular hole 18, and the lower end of the first rotating rod 10 is provided with a second center circular hole 19; the upper part of the first rotating joint 30 is provided with a first center hole, and the upper part of the second rotating joint 40 is provided with a second center hole 48; the rotating mechanism 100 also comprises a first screw rod 70 and a second screw rod 71, only the final segment of each of the two screw rods 70 and 71 is provided with external threads, and the residual rod segments are polished rod segments; the first screw rod 70 is screwed in a threaded hole arranged in the first mounting seat 601 after the first screw rod 70 passes through the first center circular hole 18 and the first center hole 38 in turn, and the second screw rod 71 is screwed in a threaded hole arranged in the second mounting seat 801 after the second screw rod 71 passes through the second center circular hole 19 and the second center hole 48 in turn, so as to ensure that the upper end 11 of the first rotating rod 10 can rotate relatively to the first screw rod 70 (the polished rod segment), and the lower end 12 of the first rotating rod 10 can rotate relatively to the second screw rod 71 (the polished rod segment); in the same plane, the connecting line of the first center hole 38 and the first shaft hole 33 is in parallel with the connecting line of the second center hole 48 and the second shaft hole 43, and the connecting line of the first center hole 38 and the second center hole 48 is in parallel with the connecting line of the first shaft hole 33 and the second shaft hole 43.

Figure 8:
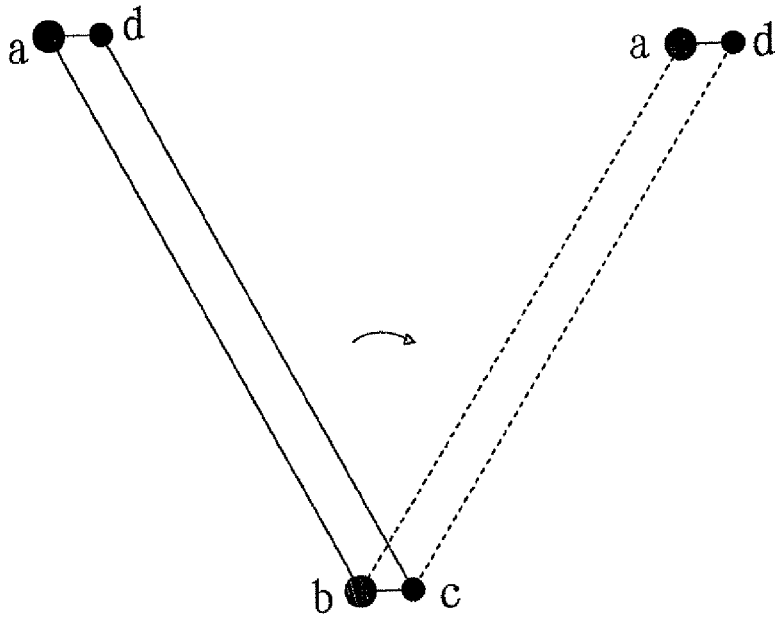
FIG. 8 is the schematic diagram of the principle of the rotating process of the rotating mechanism of the chair with a back-and-forth moving backrest.

The chair with a back-and-forth moving backrest of the invention realizes that in the rotating process of the rotating mechanism 100, the backrest 600 only moves back and forth relatively to the seat 800 without changing the vertical state of the backrest 600. The realizing principle is as shown in FIG. 8, according to the parallelogram principle, if two parallel edges of a parallelogram rotate round the intersection point of four opposite angles, the other two parallel edges will keep parallel all the time. As shown in FIG. 8, the first rotating rod 10 and the second rotating rod 20 correspond to the two parallel edges ab and cd in the figure; the first center hole 38 in the first rotating joint 30 (or the first center circular hole 18) and the first shaft hole 33 correspond to point a and point d in the figure; the second center hole 48 in the second rotating joint 40 (or the second center circular hole 19 in the lower end of the first rotating rod 10) and the second shaft hole 43 correspond to point b and point c in the figure; at beginning, edge ad and edge bc are horizontal, and edge ad moves back and forth relatively to edge bc and keeps horizontal all the time in the rotating process of edge ab and edge cd. Corresponding to the chair, the first mounting seat 601 at the lower end of the backrest 600 of the chair and the first rotating joint 30 are connected and fixed, that is to say the backrest 600 is vertically fixed to edge ad (the other side of the backrest is provided with a rotating mechanism), the second mounting seat 801 at the side of the seat 800 and the second rotating joint are connected and fixed, that is to say the visual seat 800 corresponds to edge bc, and thus, in the rotating process of the rotating mechanism 100, the backrest 600 can move back and forth relatively to the seat 800 without changing the vertical state of the backrest 600. The invention uses the parallelogram principle skillfully, and the four angles of the parallelogram point a, point b, point c and point d are four centers of rotation, so that the upper end of the first rotating rod 10 and the upper end of the second rotating rod 20 can rotate relatively to the backrest 600, and the lower end of the first rotating rod 10 and the lower end of the second rotating rod 20 can rotate relatively to the seat 800 and are in parallel with the seat 800; the rotation of the first rotating rod 10 and the second rotating rod 20 is converted into the back-and-forth translation of the backrest 600.

Figure 7:
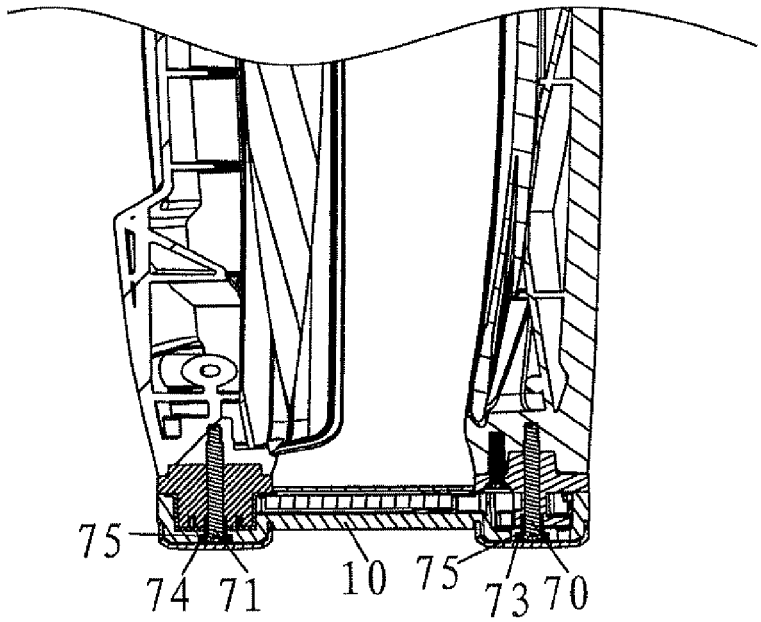
FIG. 7 is the schematic diagram of the C-C section view in FIG. 5.

In order to make the structure of the whole mechanism compact, as shown in FIG. 2 and FIG. 7, a first sleeve 73 is arranged between the first screw rod 70 and the first center circular hole 18, and a second sleeve 74 is arranged between the second screw rod 71 and the second center circular hole 19; the end of the first sleeve 73 and the end of the second sleeve 74 are both provided with sawteeth, and the sawteeth are respectively inserted into the first center hole 38 and second center hole 48; after the first sleeve 73 and the second sleeve 74 are arranged, the first screw rod 70 and the second screw rod 71 respectively press the first sleeve 73 and the second sleeve 74; the upper end 11 of the first rotating rod 10 can rotate relatively to the first sleeve 73, and the lower end 12 of the first rotating rod 10 can rotate relatively to the second sleeve 74. When the rotating mechanism rotates, because the two sleeves 73 and 74 are provided with the sawteeth which are respectively inserted into the two rotating joints to be fixed, the rotating friction can not cause the rotating mechanism to rotate, so as to avoid the long-time movement of the mechanism, and the rotating friction can cause the screw rod to withdraw, so that the whole structure is more reliable and safer.

Because the rotating rods, the rotating joints and screw rods are all made of metal, the direct contact causes serious abrasion, and in the process of movement, large noise occurs, soundproof pieces or washers and the like made of plastic cement or other metalloid materials are arranged between the rotating rods, the rotating joints and screw rods. Specifically, as shown in FIG. 2, a soundproof washer 75 is arranged between the first sleeve 73 and the first center circular hole 18, and a soundproof washer 75 is arranged between the second sleeve 74 and the second center circular hole 19; a first soundproof piece 77 is arranged between the upper end 11 of the first rotating rod 10 and the outer end 39 of the first rotating joint 30, and the upper part of the first soundproof piece 77 is provided with a through hole through which the first screw rod 70 and the first shaft rod 23 can pass; a second soundproof piece 76 is arranged between the lower end 12 of the first rotating rod 10 and the outer end 49 of the second rotating joint 40, and the upper part of the second soundproof piece 76 is provided with a through hole through which the second screw rod 71 and the second shaft rod 24 can pass; a soundproof sheet ring 78 is arranged between the upper end of the second rotating rod 20 and the first rotating joint 30, and a soundproof sheet ring 78 is arranged between the lower end of the second rotating rod 20 and the second rotating joint 40.

Figure 6:
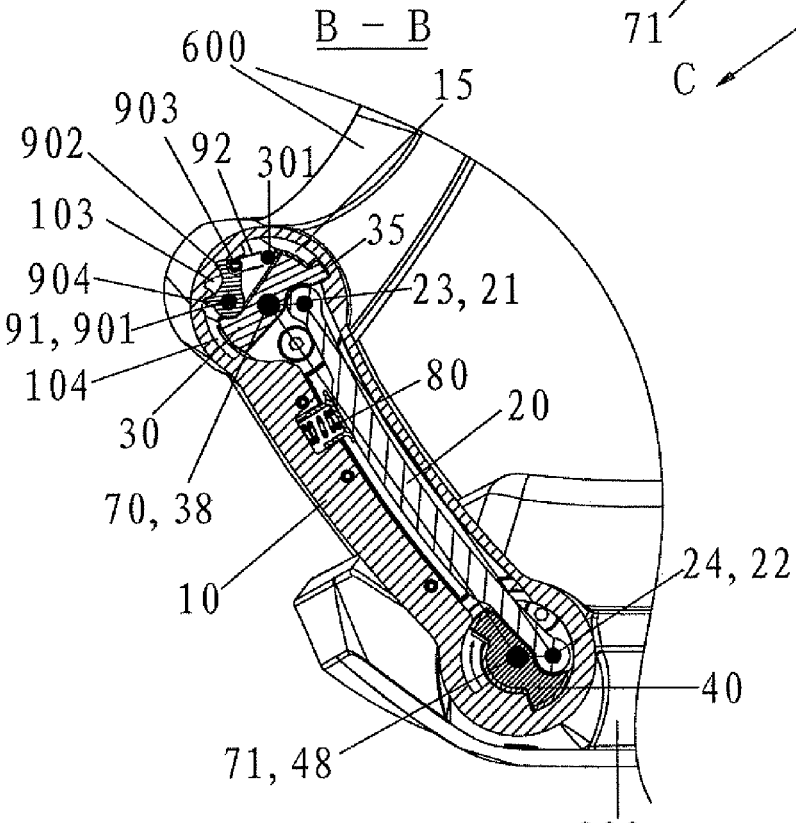
FIG. 6 is the schematic diagram of the B-B section view in FIG. 4.

In order to enhance the pretightening force in the process of movement of the mechanism to cause all the fittings not to be loose during movement, in particular to ensure the parallel relationship of the first rotating rod 10 and the second rotating rod 20, as shown in FIG. 6, a first spring 80 is arranged between the first rotating rod 10 and the second rotating rod 20.

As shown in FIG. 6, FIG. 9 and FIG. 11, a spacing lug 35 extrudes outwards from the arc wall of the outer end 39 of the first rotating joint 30, and an arc-shaped groove 15 matched with the spacing lug 35 is arranged on the inner wall of the upper end 11 of the first rotating rod 10; because the length of the arc-shaped groove 15 is determined, and the spacing lug 35 obstructs the rotating rod 10, the rotation of the rotating rod 10 is limited in a certain range to ensure the reliability and the accuracy of products.

Similarly, corresponding to the above contents, the inner wall of the lower end of the first rotating rod 10 is provided with an arc-shaped boss 16, and an arc-shaped space 46 matched with the arc-shaped boss 16 is left on the outer end of the second rotating joint 40. Thus, the rotation of the rotating rod 10 is limited in a certain range to ensure the reliability and the accuracy of products; particularly, when the rotating rod 10 rotates to a limit position, the arc-shaped boss 16 obstructs and supports the first rotating rod 10 to prevent the first rotating rod 10 from continuing rotating, and the first rotating rod 10 can only be in reversing rotation.

In order to enable the backrest 600 to realize multi-shift back-and-forth movement for well adapting to the needs of users' different sitting postures, in the chair with a back-and-forth moving backrest, in accordance with shown in FIG. 2, FIG. 3, FIG. 9 and FIGS. 11 to 18, the rotating mechanism 100 also comprises a spacing regulating member which comprises a spacing regulating buckle 90, a mounting rotation shaft 91 and a pressure spring 92; the first rotating joint 30 is provided with a mounting hole 37, one end of the mounting rotation shaft 91 can be rotatably mounted in the mounting hole 37, and the other end of the mounting rotation shaft 91 is inserted into the circular hole 901 in one end of the spacing regulating buckle 90; the other end of the spacing regulating buckle 90 is provided with an arc-shaped lug boss 902, and a wave groove 103 matched with the arc-shaped lug boss 902 is arranged on the inner wall of the upper end 11 of the first rotating rod 10; one end of the pressure spring 92 is connected with a small circular cylinder 903 at the end of the spacing regulating buckle 90 with the arc-shaped lug boss 902, and the other end of the pressure spring 92 is connected with the first rotating joint 30 by a fixed shaft 301; the mounting end of the spacing regulating buckle 90 is provided with a small lug 904, an arc-shaped groove 104 in which the small lug 904 can move is arranged on the inner wall of the upper end 11 of the first rotating rod 10, and the end of the arc-shaped groove 104 is the origin of the wave groove 103; most of the spacing regulating member is positioned in the cavity of the first rotating joint 30.

Figure 14:
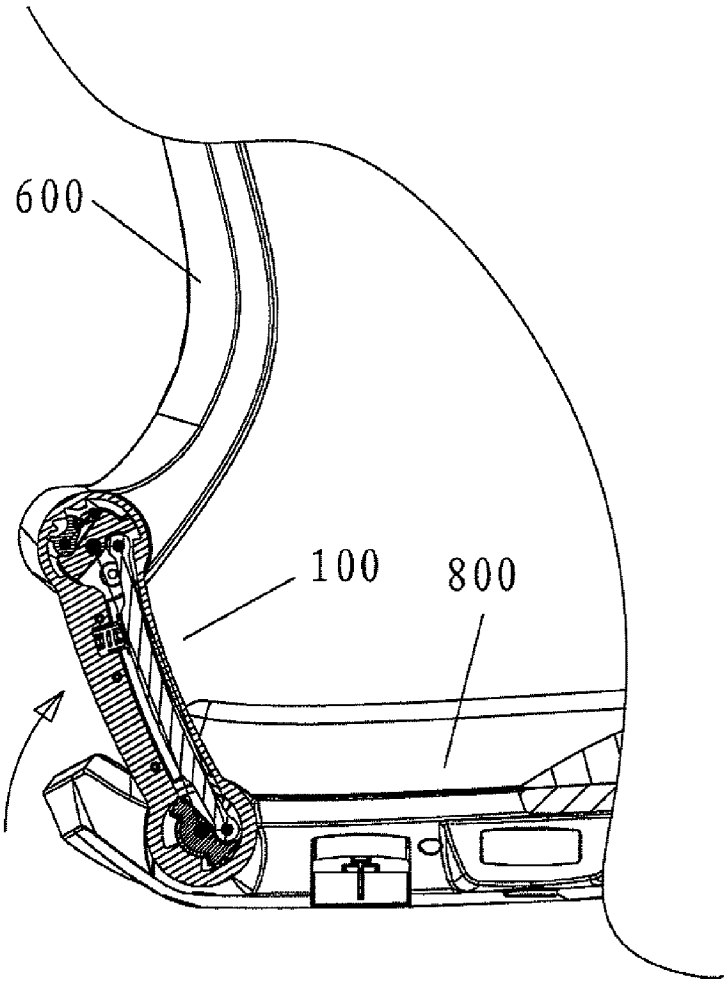
FIG. 13 to FIG. 18 show the rotating regulation process of Embodiment 1 of the chair with a back-and-forth moving backrest.
Figure 13:
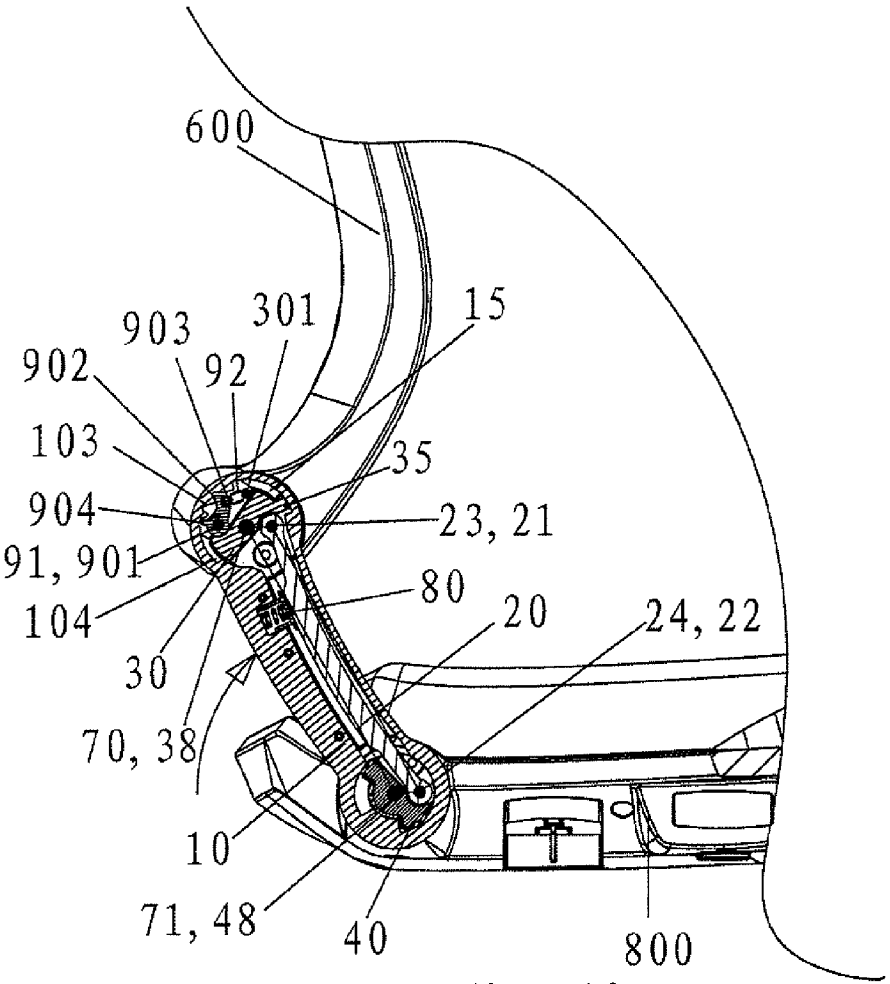
Figure 16:
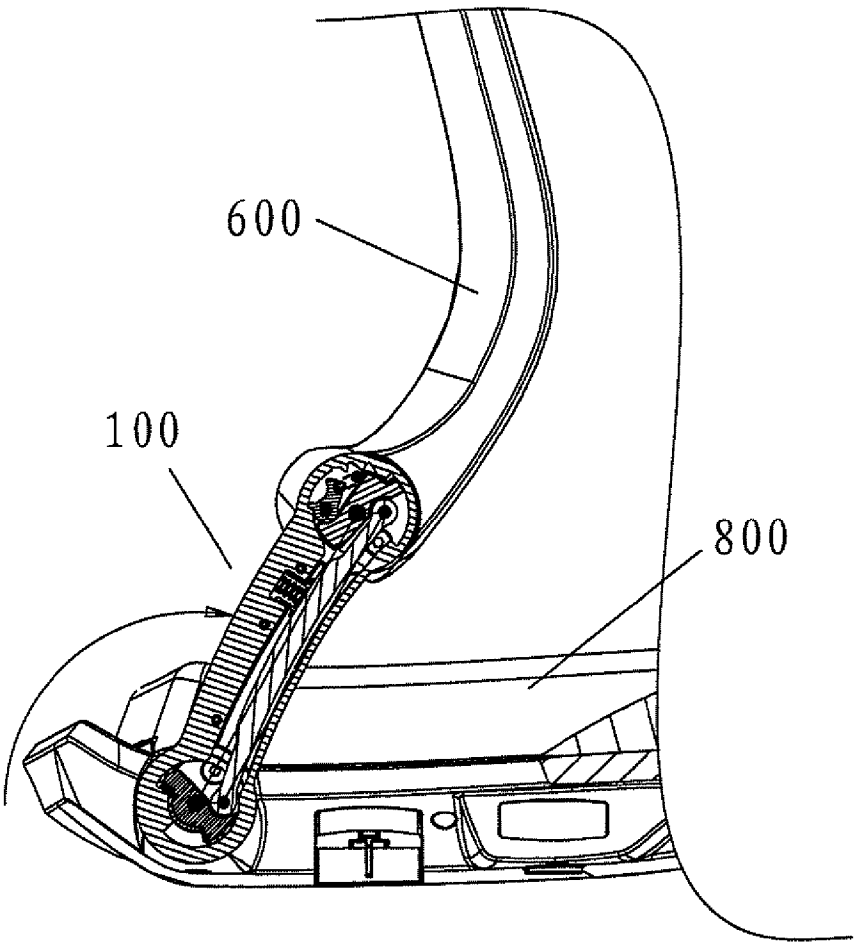
Figure 15:
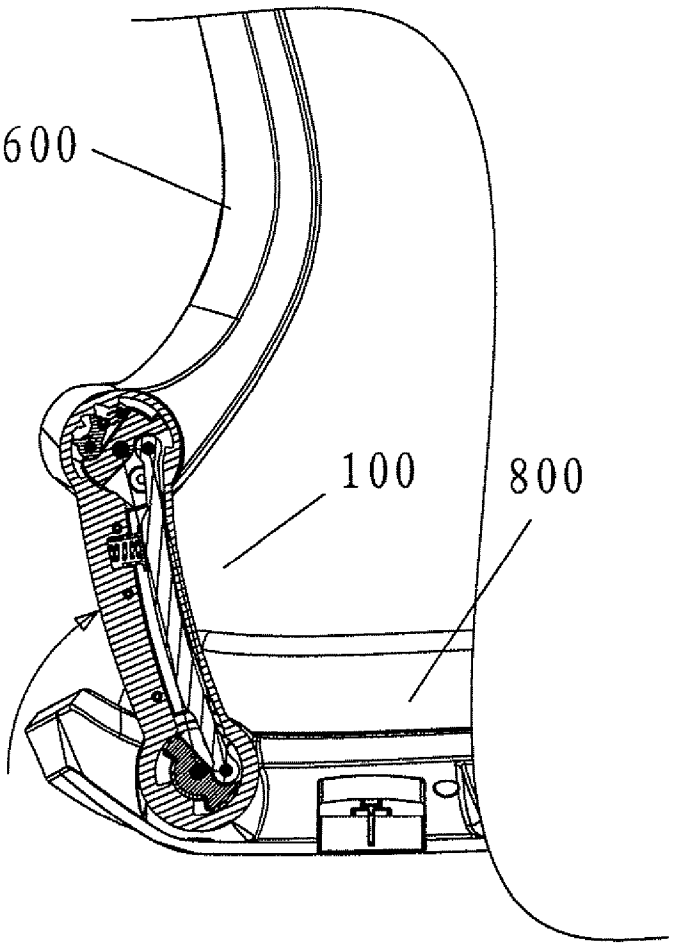
Figure 18:
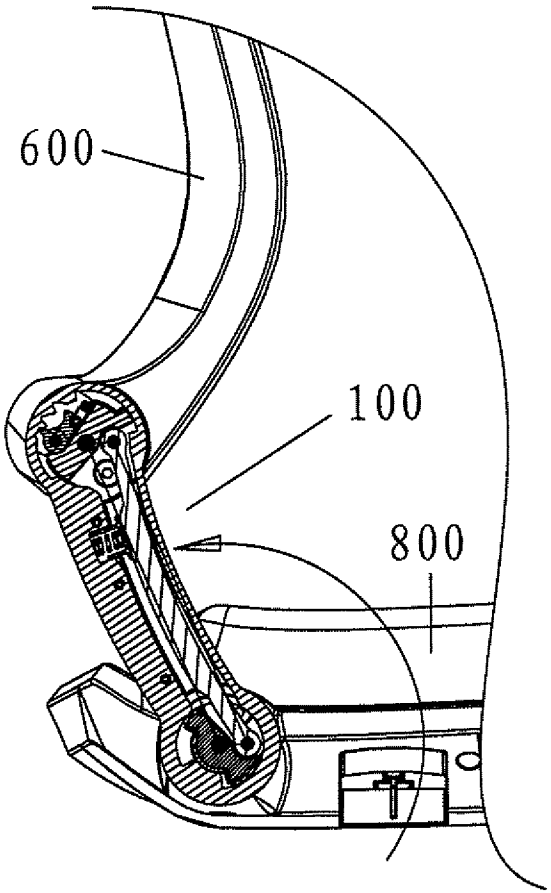
Figure 17:
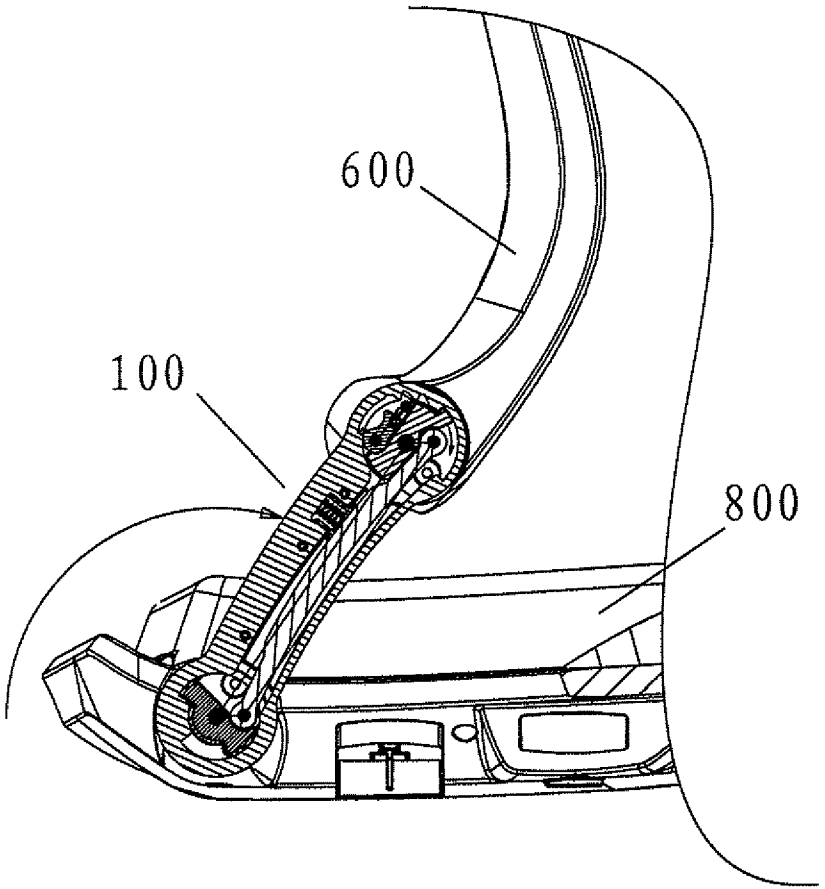

In accordance with FIGS. 13 to 18, the multi-shift spacing regulation principle and process of the rotating mechanism 100 is simply described as follows: the backrest 600 is positioned at the final end in the initial state, at the moment, the arc-shaped lug boss 902 of the spacing regulating buckle 90 is positioned in one wave trough of the uppest end of the wave groove 103 under the action of the pressure spring 92, the rotating mechanism 100 is rotated along the arrow direction in figures (namely that the backrest 600 forwardly moves), the arc-shaped lug boss 902 of the spacing regulating buckle 90 is slowly pushed out by the wave crest of the wave groove 103 on the first rotating rod 10, as shown in FIGS. 13 to 15, the arc-shaped lug boss 902 slides across the wave crest of the wave groove 103, the arc-shaped lug boss 902 is pressed into the next wave trough of the wave groove 103 under the action of the pressure spring 92 to realize the regulating and spacing processes of the next shift, the following shift regulation principles are the same as the principle, and the number of the regulated shifts are determined according to the designed number of the waves of the wave groove 103. When the backrest 600 needs to move backwardly, as shown in FIGS. 16 to 18, continue to forwardly rotatably regulate to the last shift firstly, then continue to enable the rotating mechanism 100 to forwardly rotate (as shown in FIG. 16) until the small lug 904 moves to the origin of the arc-shaped groove 104, namely a limit state (as shown in FIG. 16), then continue to apply force to rotate continuously, at the moment, the origin of the arc-shaped groove 104 acts on the small lug 904 to force the spacing regulating buckle 90 to rotate to another angle, at the same time the spacing regulating buckle 90 keeps the state under the action of the pressure spring 92 (as shown in FIG. 17), thus, the arc-shaped lug boss 902 can not stop any wave crest of the wave groove 103, at the moment the rotating mechanism 100 can be backwardly rotated along the arrow direction as shown in FIG. 18 until the initial wave crest of the wave groove 103 touches the small lug 904 to overcome the force of the direction when the pressure spring 92 is in the state as shown in FIG. 17, the pressure direction of the pressure spring 92 is changed again, the arc-shaped lug boss 902 falls into the wave trough of the wave groove again, and circulate like this.

Figure 3:
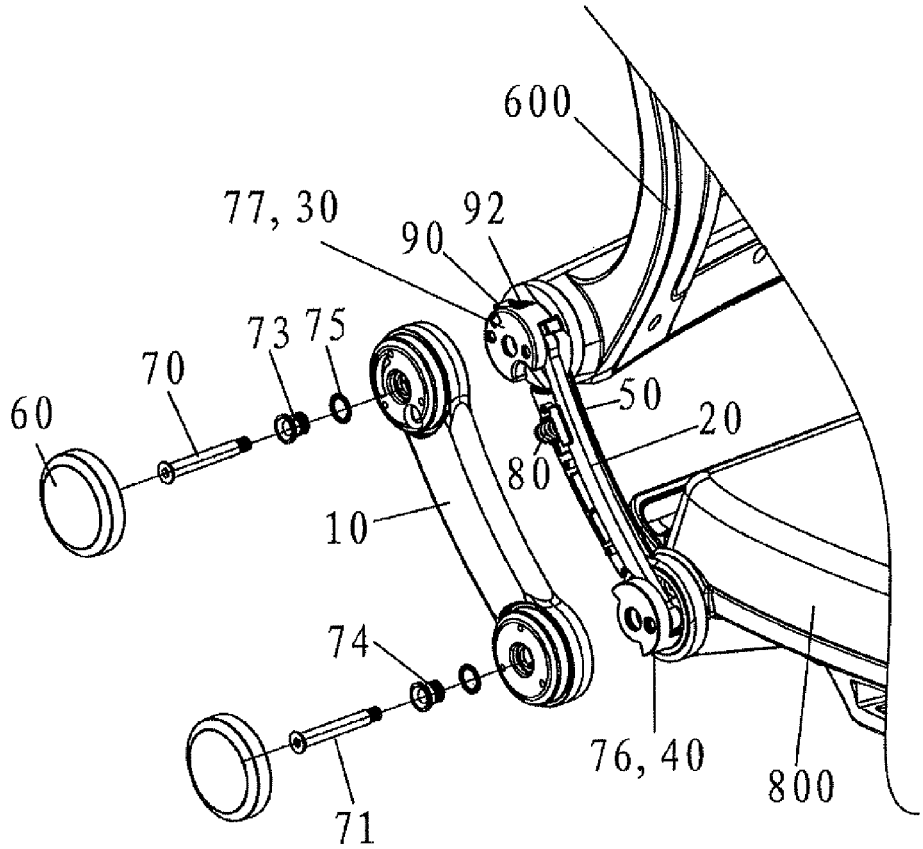
FIG. 3 is the schematic diagram of the assembly process of Embodiment 1 of the chair with a back-and-forth moving backrest.
Figure 4:
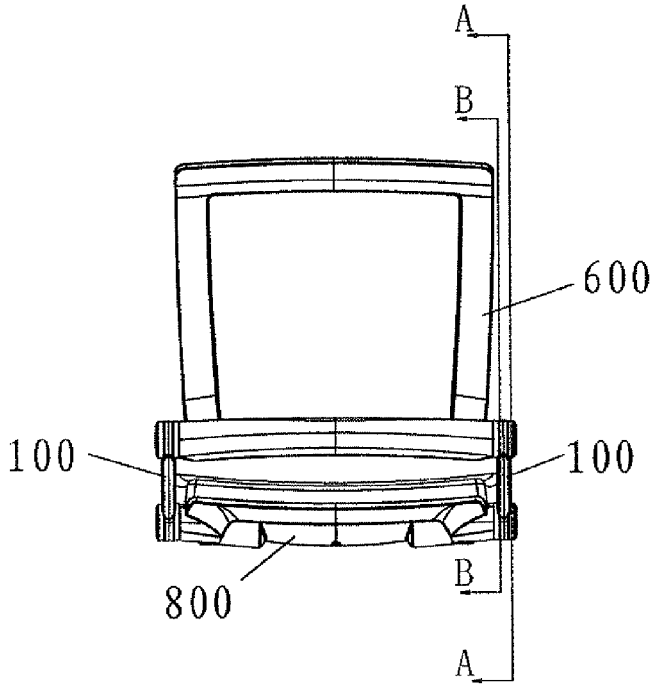
FIG. 4 is the schematic diagram of the back sight of Embodiment 1 of the chair with a back-and-forth moving backrest.
Figure 5:
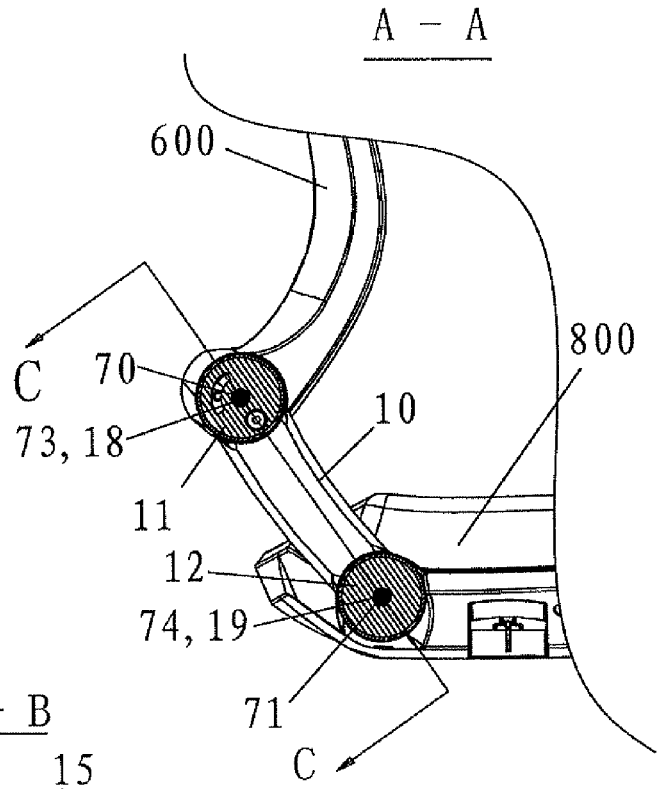
FIG. 5 is the schematic diagram of the A-A section view in FIG. 4.
Figure 19:
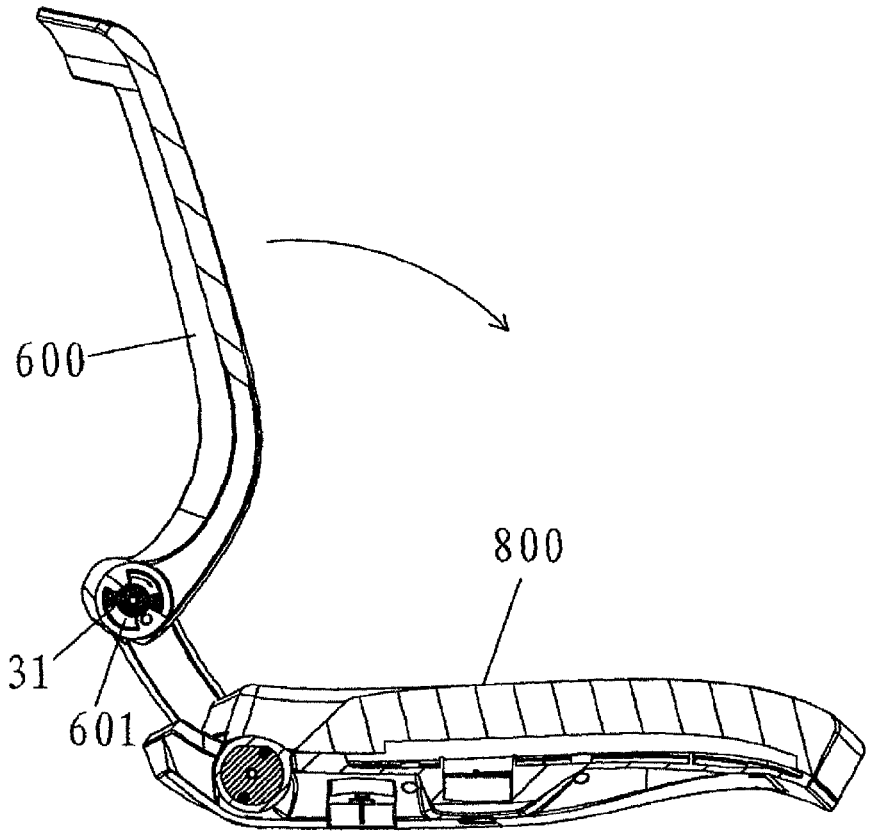
FIG. 19 and FIG. 20 show the process that the backrest closes up to the seat of Embodiment 1 of the chair with a back-and-forth moving backrest.
Figure 20:
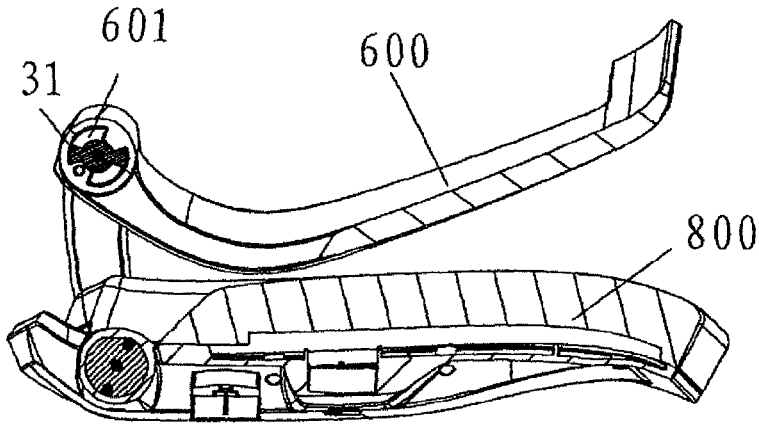
Figure 21:
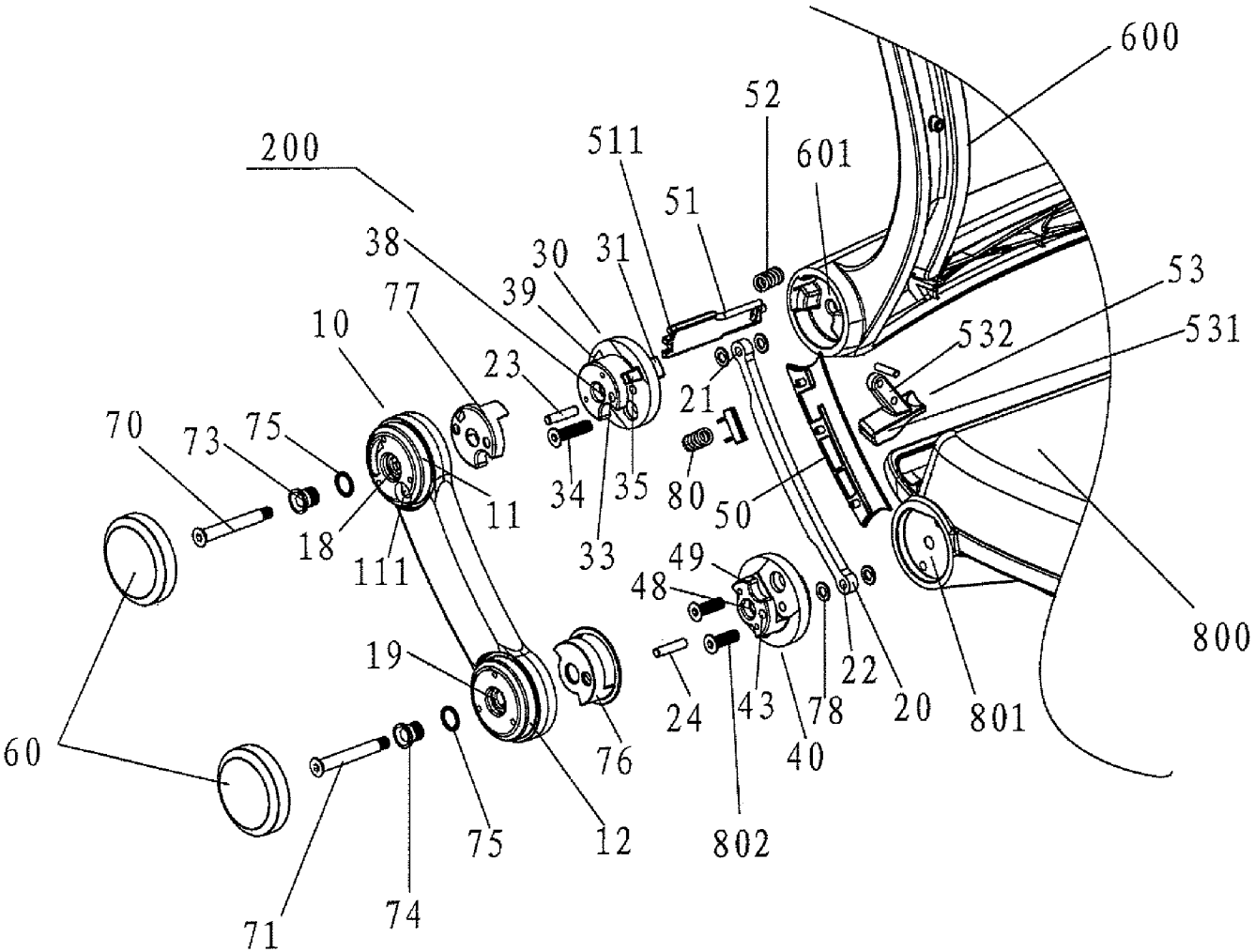
FIG. 21 is the schematic diagram of the three-dimensional disassembly of Embodiment 2 of the chair with a back-and-forth moving backrest.
Figure 22:
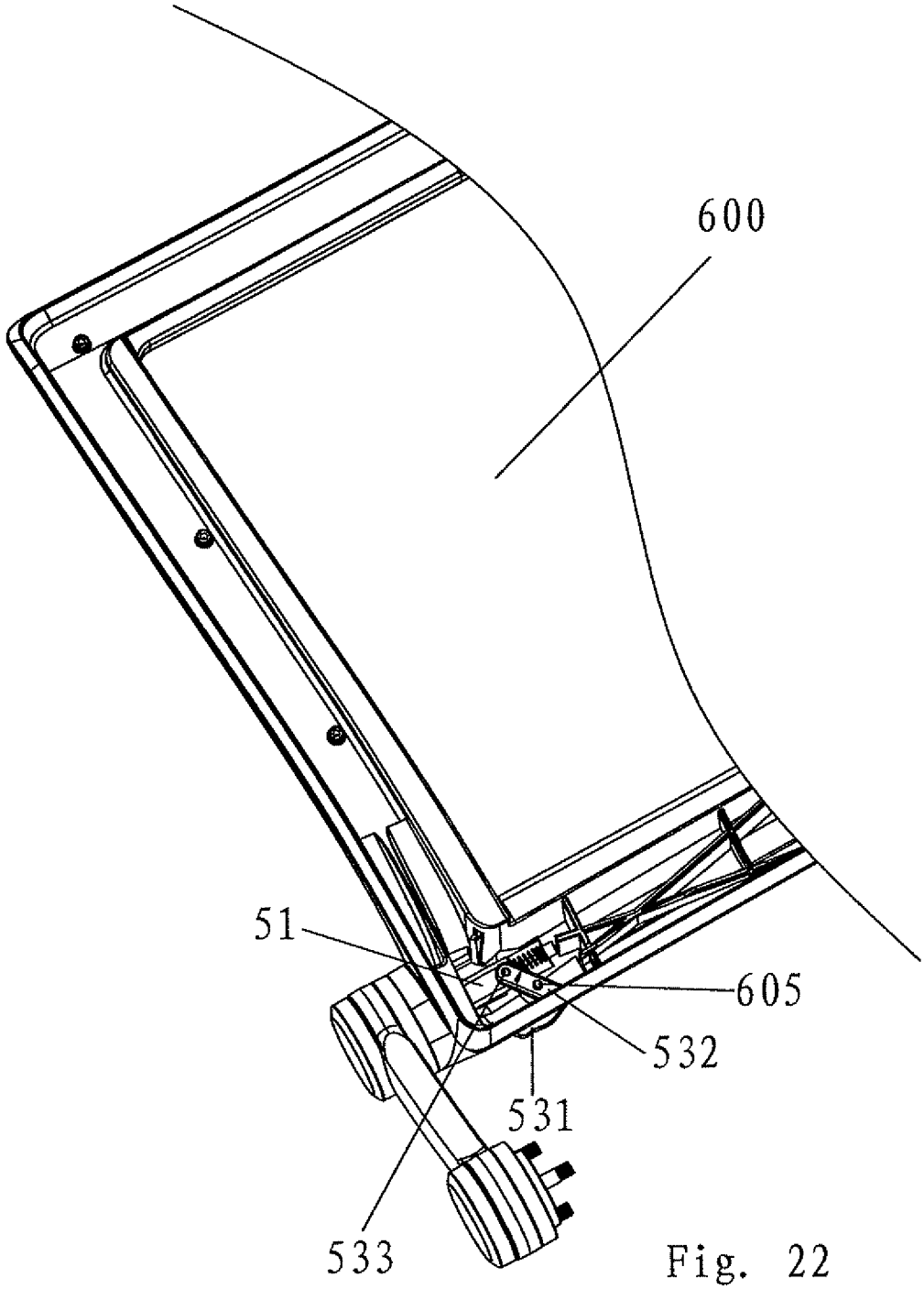
FIG. 22 shows the connection relationship of the spacing regulating member and the backrest of Embodiment 2 of the chair with a back-and-forth moving backrest.
Figure 24:
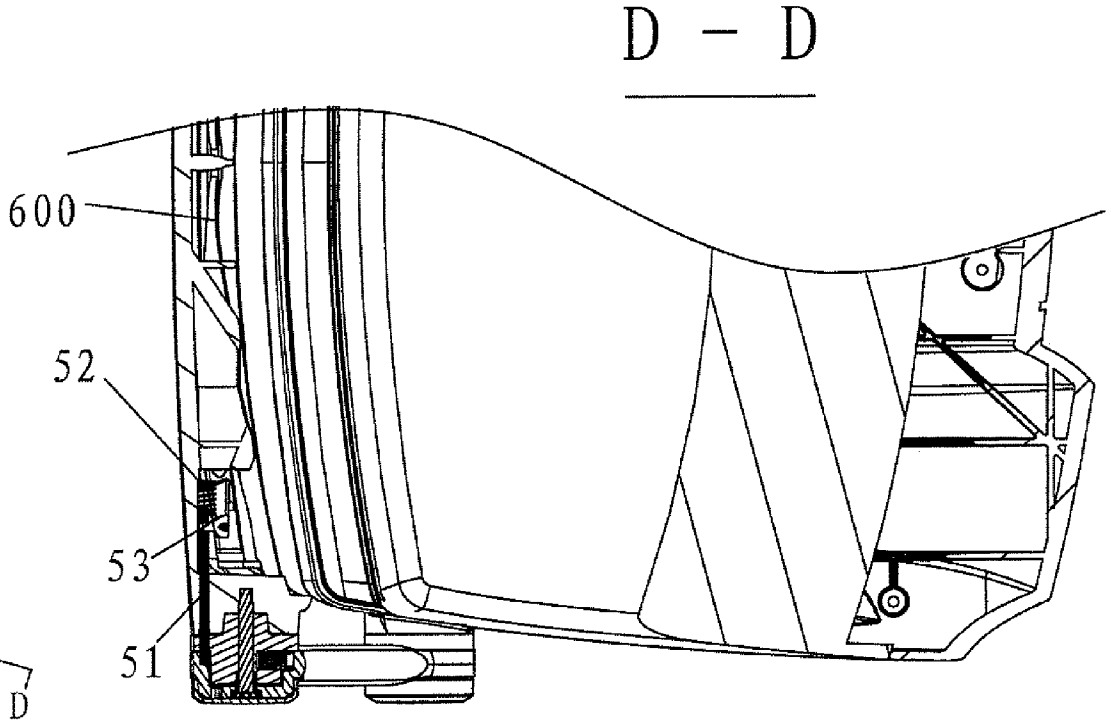
FIG. 24 is the schematic diagram of the D-D section view in FIG. 23.
Figure 23:
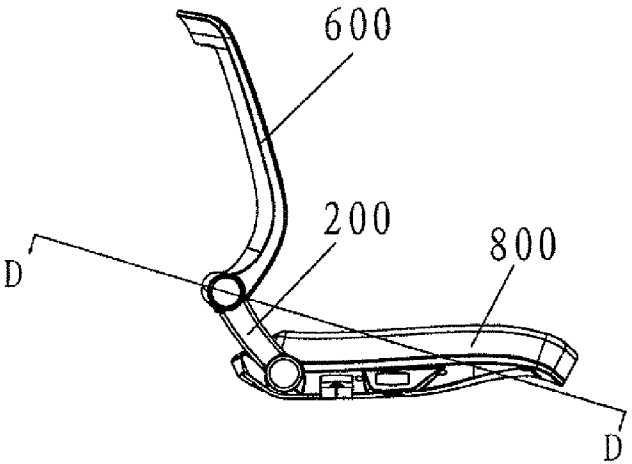
FIG. 23 is the schematic diagram of the structure of Embodiment 2 of the chair with a back-and-forth moving backrest.
Figure 25:
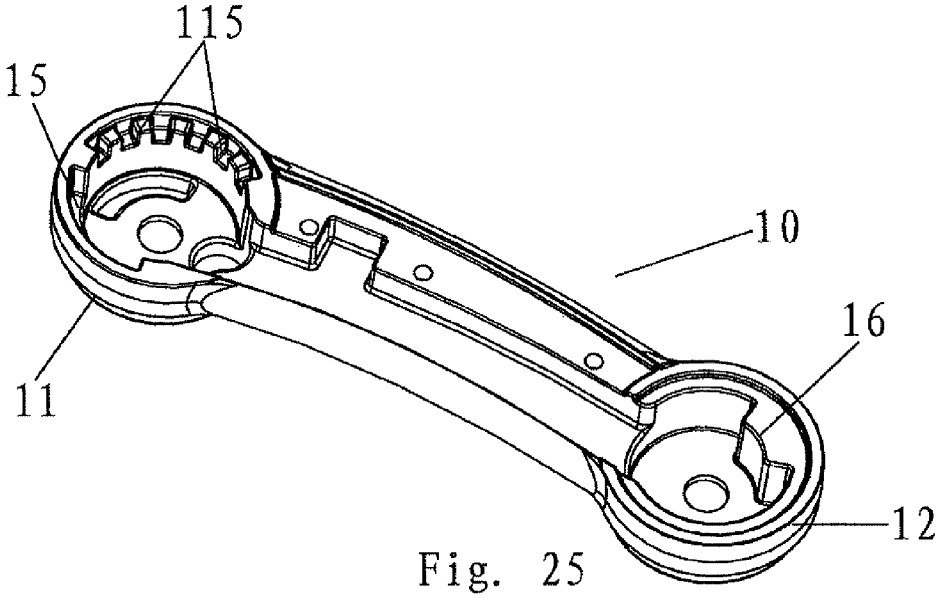
FIG. 25 is the schematic diagram of the three-dimensional structure of the first rotating rod of Embodiment 2 of the chair with a back-and-forth moving backrest.
Figure 26:
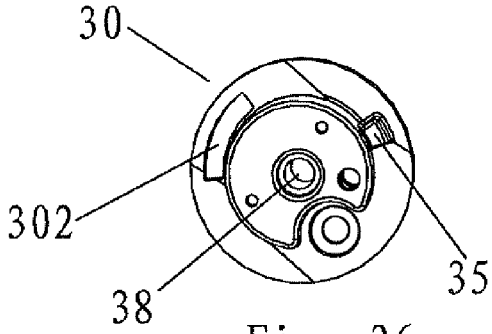
FIG. 26 is the schematic diagram of the three-dimensional structure of the first rotating joint of Embodiment 2 of the chair with a back-and-forth moving backrest.
Figure 27:
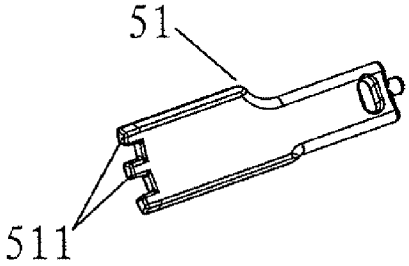
FIG. 27 is the schematic diagram of the three-dimensional structure of the arc-shaped locking plate of Embodiment 2 of the chair with a back-and-forth moving backrest.
Figure 28:
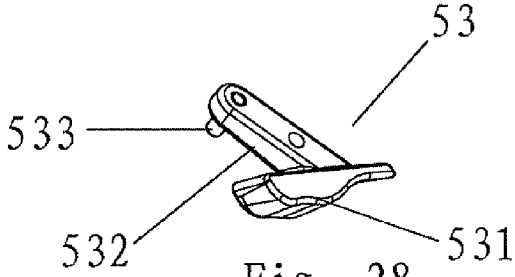
FIG. 28 is the schematic diagram of the three-dimensional structure of the regulating switch of Embodiment 2 of the chair with a back-and-forth moving backrest.

As shown in FIG. 2 and FIG. 3, the first rotating joint 30 is removably connected with the first mounting seat 601 by a third screw rod 34, the upper end 11 of the first rotating rod 10 is provided with a through hole 111, and the third screw rod 34 passes through the through hole 111; thus, the third screw rod 34 and the circular end cap 60 can be not pre-assembled during assembly, at the moment, the first mounting seat 601 can rotate relatively to the first rotating joint 30, namely that the backrest 600 can rotate relatively to the rotating mechanism 100, and therefore, the backrest 600 can be folded and closed up toward the seat as shown in FIGS. 19 to 20 to reduce the occupied space of the chair and make transportation convenient. As shown in figures, the inner end 31 of the first rotating joint 30 is designed into a bowknot shape, the inner part of the first mounting seat 601 is designed into a shape matched with the inner end 31 of the first rotating joint 30, thus, the rotating range of the backrest 600 is limited, and the damage of the backrest 600 caused by excess rotation is avoided.

Embodiment 2

Figure 31:
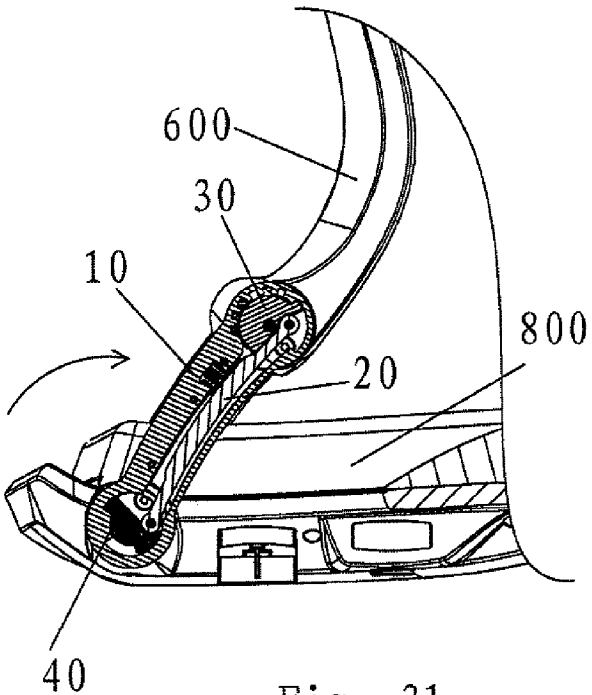
FIG. 29 to FIG. 31 show the rotating regulation process of Embodiment 2 of the chair with a back-and-forth moving backrest.
Figure 30:
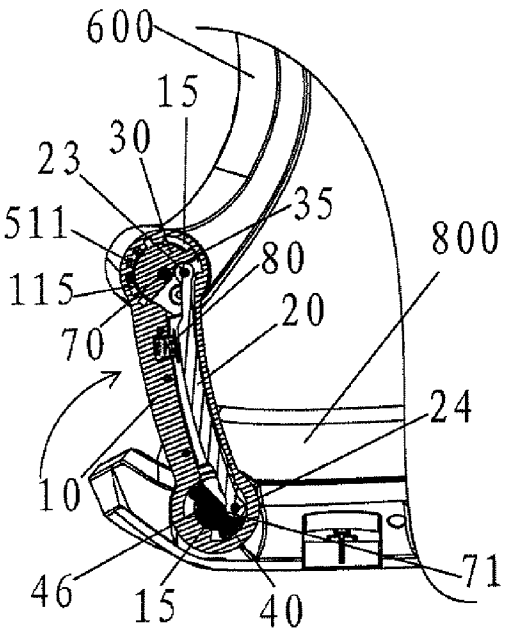
Figure 29:
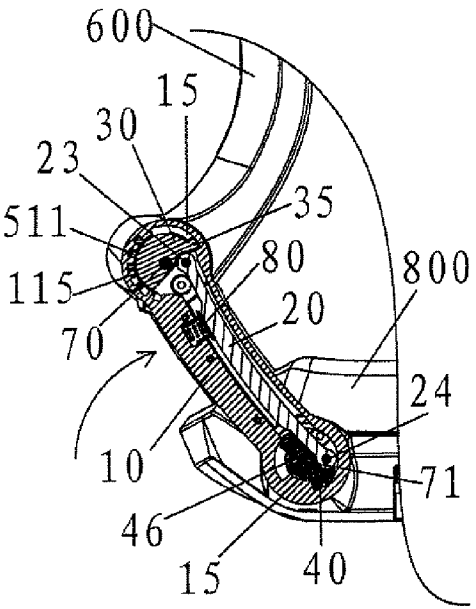

Embodiment 2 of the chair with a back-and-forth moving backrest of the invention, as shown in FIGS. 21 to 28, basically has the same structure and principle as Embodiment 1 and has different points that the rotating mechanism 200 is designed to have multi-shift spacing control regulation, specifically:

the rotating mechanism 200 comprises a spacing regulating member which comprises an arc-shaped locking plate 51, a second spring 52 and a regulating switch 53, wherein, the inner end of the arc-shaped locking plate 51 passes through the first mounting seat 601, then, extends into the lower end of the backrest 600, and can move in the lower end of the backrest 600, and the second spring 52 supports the inner end of the arc-shaped locking plate 51; the outer end of the arc-shaped locking plate 51 is provided with three locking teeth 511 equally distributed, an arc-shaped strip hole 302 through which the arc-shaped locking plate 51 passes is arranged in the first rotating joint 30, and wave teeth 115 matched with the locking teeth 511 are arranged on the inner wall of the upper end 11 of the first rotating rod 10; the regulating switch 53 comprises a button 531 and a regulating rod 532 which form an intersection angle mutually, wherein, the regulating rod 532 can be rotatably mounted in the lower end of the backrest 600 by a pin 605 (the pin is mounted or directly formed in the lower end of the backrest 600), and the end of the regulating rod 532 is connected with the inner end of the arc-shaped locking plate 51 by a reinforced core 533 (the reinforced core 533 can be one-batch formed with the regulating rod) (specifically, the inner end of the arc-shaped locking plate 51 is provided with a small hole, and the reinforced core 533 is inserted into the small hole to realize connection). The principle and process of the specific multi-shift spacing control regulation are in accordance with shown in FIGS. 29 to 31, in a certain shift, the arc-shaped locking plate 51 is under the action of the second spring 52 to enable the locking teeth 511 to embed into the troughs of the wave teeth corresponding to the shift, the button 531 of the regulating switch 53 is pressed when regulation is needed, the regulating rod 532 rotates and overcomes the elastic force action of the second spring 52 to enable the arc-shaped locking plate 51 to step back until the locking teeth 511 step back out of the wave teeth 115, namely that the rotating mechanism 200 can be rotated, the button 531 is released when regulation is in place, the arc-shaped locking plate 51 is under the action of the second spring, and the locking teeth 511 of the arc-shaped locking plate 51 are embedded into the troughs of the wave teeth corresponding to a new shift again.

In Embodiment 2, the backrest 600 can also be folded and closed up toward the seat 800 under the condition that the third screw rod 34 and the circular end cap 60 are not pre-assembled; differently, the backrest 600 can be folded into the shape as shown in FIG. 20 after the whole arc-shaped locking plate 51 is compressed into the lower end of the backrest, the backrest 600 is rotated until the arc-shaped locking plate 51 aligns the arc-shaped strip hole 302 on the first rotating joint 30 when conveniently transported to a using place, and the arc-shaped locking plate 51 can spring away automatically under the action of the second spring.

The above content is the further specific description of the invention in accordance with specific optimized technical solutions, and the specific implement of the invention can not be considered to be limited to the description. A certain of simple evolution and replacement can be made by ordinary technical persons of the technical field of the invention under the premise that the conception of the invention is not separated, and the evolution and replacement are considered to be the protected range of the invention.

What is claimed is:

1. A chair with a back-and-forth moving backrest comprising a seat, a backrest including a lower end that is separated from the seat, and a rotating mechanism connecting a side of a back end of the seat to a side of the lower end of the backrest, wherein:

the rotating mechanism comprises a first rotating rod, a second rotating rod, a first rotating joint and a second rotating joint;

the first rotating rod includes upper and lower ends and a middle segment connecting the upper and lower ends;

upper and lower ends of the second rotating rod each include a circular hole;

the first rotating joint includes a middle segment, an inner segment, and an outer segment;

a first mounting seat is connected and fixed at one of the sides of the lower end of the backrest, and the inner segment of the first rotating joint is inserted into the first mounting seat;

the second rotating joint includes a middle segment, an inner segment, and an outer segment;

a second mounting seat is connected and fixed at one of the sides of the back end of the seat, and the inner segment of the second rotating joint is inserted into the second mounting seat;

the inner segment of the first rotating joint includes a first groove and a first shaft hole, the upper end of the second rotating rod is positioned in the first groove, a first shaft rod is inserted into the first shaft hole and the circular hole in the upper end of the second rotating rod;

the inner segment of the second rotating joint includes a second groove and a second shaft hole, the lower end of the second rotating rod is positioned in the second groove, a second shaft rod is inserted into the second shaft hole and the circular hole in the lower end of the second rotating rod;

the upper end of the first rotating rod is sheathed with the outer segment of the first rotating joint, and the lower end of the first rotating rod is sheathed with the outer segment of the second rotating joint;

the upper end of the first rotating rod includes a first center circular hole, and the lower end of the first rotating rod includes a second center circular hole;

the first rotating joint includes a first center hole, and the second rotating joint includes a second center hole;

the rotating mechanism comprises a first screw rod and a second screw rod, the first screw rod extends through the first center circular hole and the first center hole, and is screwed in a threaded hole in the first mounting seat, and the second screw rod extends through the second center circular hole and the second center hole and is screwed in a threaded hole in the second mounting seat, wherein the upper end of the first rotating rod can rotate relatively to the first screw rod, and the lower end of the first rotating rod can rotate relatively to the second screw rod;

a line extending between the first center hole and the first shaft hole is parallel with a line extending between the second center hole and the second shaft hole, and a line extending between the first center hole and the second center hole is parallel with a line extending between the first shaft hole and the second shaft hole; and during rotation of the rotating mechanism relative to the backrest and the seat, the vertical state of the backrest is maintained relative to the seat.

2. The chair of claim 1 wherein:

a first sleeve is arranged between the first screw rod and the first center circular hole, the first sleeve having an end that includes sawteeth, which are inserted into the first center hole;

a second sleeve is arranged between the second screw rod and the second center circular hole, the second sleeve having an end that includes sawteeth, which are inserted in the second center hole; and the upper end of the first rotating rod is configured to rotate relative to the first sleeve, and the lower end of the first rotating rod is configured to rotate relative to the second sleeve.

3. The chair of claim 1, further comprising a first spring between the first rotating rod and the second rotating rod.

4. The chair of claim 1, wherein a spacing lug extends outwards from an arc wall of the outer segment of the first rotating joint, and an arc-shaped groove matched with the spacing lug is arranged on an inner wall of the upper end of the first rotating rod.

5. The chair of claim 1, wherein an inner wall of the lower end of the first rotating rod is provided with an arc-shaped boss, and an arc-shaped space matched with the arc-shaped boss is positioned on the outer segment of the second rotating joint.

6. The chair of claim 1, wherein the rotating mechanism includes a spacing regulating member comprising a spacing regulating buckle, a mounting rotation shaft and a pressure spring, wherein:

a first end of the mounting rotation shaft is rotatably mounted in a mounting hole arranged in the first rotating joint, and a second end of the mounting rotation shaft is inserted into a circular hole in a first end of the spacing regulating buckle;

a second end of the spacing regulating buckle includes an arc-shaped lug boss;

a wave groove matched with the lug boss is arranged on an inner wall of the upper end of the first rotating rod;

a first end of the pressure spring is connected with the second end of the spacing regulating buckle with the arc-shaped lug boss, and a second end of the pressure spring is connected with the first rotating joint by a fixed shaft;

the first end of the spacing regulating buckle is provided with a lug;

an arc-shaped groove, in which the lug can move, is arranged on the inner wall of the upper end of the first rotating rod, an end of the arc-shaped groove is the origin of the wave groove; and most of the spacing regulating member is positioned in a cavity of the first rotating joint.

7. The chair of claim 1 wherein the rotating mechanism comprises a spacing regulating member which comprises an arc-shaped locking plate, a second spring and a regulating switch, wherein:

an inner end of the arc-shaped locking plate extends through the first mounting seat and into the lower end of the backrest, the inner end of the arc-shaped locking plate is configured to move in the lower end of the backrest;

the second spring supports the inner end of the arc-shaped locking plate;

an outer end of the arc-shaped locking plate is provided with at least one locking tooth;

an arc-shaped strip hole, through which the arc-shaped locking plate extends, is arranged in the first rotating joint;

wave teeth matched with the locking tooth are arranged on an inner wall of the upper end of the first rotating rod; and the regulating switch comprises a button and a regulating rod, the regulating rod is rotatably mounted in the lower end of the backrest by a pin, and an end of the regulating rod is connected with the inner end of the arc-shaped locking plate by a reinforced core.

8. The chair of claim 1 wherein:

the first rotating joint is removably connected with the first mounting seat by a third screw rod, and the upper end of the first rotating rod is provided with a through hole through which the third screw rod extends; and the inner segment of the first rotating joint is designed into a bowknot shape, and an inner part of the first mounting seat is designed to be matched with the inner end of the first rotating joint.

9. A rotating mechanism configured to connect to a chair between a side of a lower end of a backrest and a side of a back end of a seat of the chair, the rotating mechanism comprising a first rotating rod, a second rotating rod, a first rotating joint and a second rotating joint, wherein:

the first rotating rod includes upper and lower ends and a middle segment connecting the upper and lower ends;

upper and lower ends of the second rotating rod each include a circular hole;

the first rotating joint includes a middle segment, an inner segment, and an outer segment;

a first mounting seat is connected and fixed at one of the sides of the lower end of the backrest, and the inner segment of the first rotating joint is inserted into the first mounting seat;

the second rotating joint includes a middle segment, an inner segment, and an outer segment;

a second mounting seat is connected and fixed at one of the sides of the back end of the seat, and the inner segment of the second rotating joint is inserted into the second mounting seat;

the inner segment of the first rotating joint includes a first groove and a first shaft hole, the upper end of the second rotating rod is positioned in the first groove, a first shaft rod is inserted into the first shaft hole and the circular hole in the upper end of the second rotating rod;

the inner segment of the second rotating joint includes a second groove and a second shaft hole, the lower end of the second rotating rod is positioned in the second groove, a second shaft rod is inserted into the second shaft hole and the circular hole in the lower end of the second rotating rod;

the upper end of the first rotating rod is sheathed with the outer segment of the first rotating joint, and the lower end of the first rotating rod is sheathed with the outer segment of the second rotating joint;

the upper end of the first rotating rod includes a first center circular hole, and the lower end of the first rotating rod includes a second center circular hole;

the first rotating joint includes a first center hole, and the second rotating joint includes a second center hole;

the rotating mechanism comprises a first screw rod and a second screw rod, the first screw rod extends through the first center circular hole and the first center hole, and is screwed in a threaded hole in the first mounting seat, and the second screw rod extends through the second center circular hole and the second center hole and is screwed in a threaded hole in the second mounting seat, wherein the upper end of the first rotating rod can rotate relatively to the first screw rod, and the lower end of the first rotating rod can rotate relatively to the second screw rod;

a line extending between the first center hole and the first shaft hole is parallel with a line extending between the second center hole and the second shaft hole, and a line extending between the first center hole and the second center hole is parallel with a line extending between the first shaft hole and the second shaft hole; and during rotation of the rotating mechanism relative to the backrest and the seat, the backrest moves back and forth relative to the seat without changing the vertical state of the backrest.

10. The rotating mechanism of claim 9, wherein:

a first sleeve is arranged between the first screw rod and the first center circular hole, the first sleeve having an end that includes sawteeth, which are inserted into the first center hole;

a second sleeve is arranged between the second screw rod and the second center circular hole, the second sleeve having an end that includes sawteeth, which are inserted in the second center hole; and the upper end of the first rotating rod is configured to rotate relative to the first sleeve, and the lower end of the first rotating rod is configured to rotate relative to the second sleeve.

11. The rotating mechanism of claim 9, wherein a spacing lug extends outwards from an arc wall of the outer segment of the first rotating joint, and an arc-shaped groove matched with the spacing lug is arranged on an inner wall of the upper end of the first rotating rod.

12. The rotating mechanism of claim 9, wherein the rotating mechanism includes a spacing regulating member comprising a spacing regulating buckle, a mounting rotation shaft and a pressure spring, wherein:

a first end of the mounting rotation shaft is rotatably mounted in a mounting hole arranged in the first rotating joint, and a second end of the mounting rotation shaft is inserted into a circular hole in a first end of the spacing regulating buckle;

a second end of the spacing regulating buckle includes an arc-shaped lug boss;

a wave groove matched with the lug boss is arranged on an inner wall of the upper end of the first rotating rod;

a first end of the pressure spring is connected with the second end of the spacing regulating buckle with the arc-shaped lug boss, and a second end of the pressure spring is connected with the first rotating joint by a fixed shaft;

the first end of the spacing regulating buckle is provided with a lug;

an arc-shaped groove, in which the lug can move, is arranged on the inner wall of the upper end of the first rotating rod, an end of the arc-shaped groove is the origin of the wave groove; and most of the spacing regulating member is positioned in a cavity of the first rotating joint.

13. The rotating mechanism of claim 9, wherein the rotating mechanism comprises a spacing regulating member which comprises an arc-shaped locking plate, a second spring and a regulating switch, wherein:

an inner end of the arc-shaped locking plate extends through the first mounting seat and into the lower end of the backrest, the inner end of the arc-shaped locking plate is configured to move in the lower end of the backrest;

the second spring supports the inner end of the arc-shaped locking plate;

an outer end of the arc-shaped locking plate is provided with at least one locking tooth;

an arc-shaped strip hole, through which the arc-shaped locking plate extends, is arranged in the first rotating joint;

wave teeth matched with the locking tooth are arranged on an inner wall of the upper end of the first rotating rod; and the regulating switch comprises a button and a regulating rod, the regulating rod is rotatably mounted in the lower end of the backrest by a pin, and an end of the regulating rod is connected with the inner end of the arc-shaped locking plate by a reinforced core.

* * * * *